US007168785B2

(12) United States Patent
Bates et al.

(10) Patent No.: US 7,168,785 B2
(45) Date of Patent: Jan. 30, 2007

(54) METHOD FOR PERFORMING EDGE-TO-EDGE TRANSITION DURING PRINTING WITH AN IMAGING APPARATUS

(75) Inventors: John B. Bates, Harrodsburg, KY (US); Bruce A. DeBoard, Lexington, KY (US); Kenneth W. Linville, Winchester, KY (US); Randall D. Mayo, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 280 days.

(21) Appl. No.: 10/956,934

(22) Filed: Sep. 30, 2004

(65) Prior Publication Data

US 2006/0066669 A1 Mar. 30, 2006

(51) Int. Cl.
*B41J 2/15* (2006.01)

(52) U.S. Cl. ..... 347/41; 347/15; 347/16

(58) Field of Classification Search ..... 347/41, 347/15, 16

See application file for complete search history.

(56) References Cited

U.S. PATENT DOCUMENTS 6,874,864 B1 * 4/2005 Maeda et al. ..... 347/41
6,948,796 B2 * 9/2005 Otsuki ..... 347/41

* cited by examiner

*Primary Examiner*—Lamson Nguyen
(74) *Attorney, Agent, or Firm*—Ronald K. Aust

(57) ABSTRACT

A method of printing on a print medium includes using a first quantity of nozzles of a printhead to print a first set of scan lines of a plurality of scan lines at an edge of the print medium; using a second quantity of nozzles of the printhead to print a second set of scan lines of the plurality of scan lines in an interior region of the print medium; using a third quantity of nozzles to print a third set of scan lines of the plurality of scan lines to transition between the edge and the interior region, the third quantity of nozzles being greater in number than the first quantity of nozzles and less in number than the second quantity of nozzles; and printing each scan line of the plurality of scan lines forming the image with a same number of multiple passes of the printhead, regardless of the number of nozzles used for printing during a particular pass of the printhead.

15 Claims, 6 Drawing Sheets

METHOD FOR PERFORMING EDGE-TO-EDGE TRANSITION DURING PRINTING WITH AN IMAGING APPARATUS

BACKGROUND OF THE INVENTION

1. Field of the Invention

The present invention relates to an imaging apparatus, and, more particularly, to a method for performing an edge-to-edge transition during printing with an imaging apparatus.

2. Description of the Related Art

A typical ink jet printer forms an image on a print medium by ejecting ink from a plurality of ink jetting nozzles of an ink jet printhead to form a pattern of ink dots on the print medium. The ink jet printhead may be formed integral with a cartridge containing a supply of ink, thus forming a supply cartridge, and more particularly, a printhead cartridge. Such an ink jet printer typically includes a reciprocating printhead carrier that mounts one or more printhead cartridges in respective receptacles. Once mounted, the printhead carrier carriers the printhead cartridges across the print medium along a bi-directional scanning path defining a print zone of the printer. A sheet feeding mechanism is used to incrementally advance the print medium sheet in a sheet feed direction, also commonly referred to as a sub-scan direction, through a print zone between scans in the main scan direction, or after all data intended to be printed with the print medium at a particular stationary position has been completed.

Various techniques have been employed for facilitating edge-to-edge printing on a print medium. One such technique, for example, uses a subset of the total nozzles available for printing at an edge region of the print medium, and requires a change in the number of passes of a particular printhead that is needed to complete the printing of a scan line on a printed page depending on the location of the scan line on the printed page, thereby complicating the shingling and image formatting algorithms used to locate the printed dots on the print medium.

What is needed in the art is an edge-to-edge printing method that performs an edge-to-edge transition during printing with an imaging apparatus, without changing the number of passes needed to complete printing of a scan line with a particular printhead, regardless of the location of the scan line on the print medium.

SUMMARY OF THE INVENTION

The present invention provides an edge-to-edge printing method that performs an edge-to-edge transition during printing with an imaging apparatus, without changing the number of passes needed to complete printing of a scan line with a particular printhead, regardless of the location of the scan line on the print medium.

The present invention, in one form thereof, is directed to a method of printing on a print medium with a plurality of scan lines formed using a printhead, including using a first quantity of nozzles of the printhead to print a first set of scan lines of the plurality of scan lines at an edge of the print medium; using a second quantity of nozzles of the printhead to print a second set of scan lines of the plurality of scan lines in an interior region of the print medium; using a third quantity of nozzles to print a third set of scan lines of the plurality of scan lines to transition between the edge and the interior region, the third quantity of nozzles being greater in number than the first quantity of nozzles and less in number than the second quantity of nozzles; and printing each scan line of the plurality of scan lines forming the image with a same number of multiple passes of the printhead, regardless of the number of nozzles used for printing during a particular pass of the printhead.

The present invention, in another form thereof, is directed to an edge-to-edge printing method, including providing a color printhead having X nozzles; providing a monochrome printhead having X+N nozzles; printing at a horizontal band of scan lines located at an edge of a print medium with a first color pass using (X−Z) nozzles of the color printhead, the (X−Z) nozzles being located in a first region of the color printhead; printing at the horizontal band of scan lines located at the edge of the print medium with a first monochrome pass using (X−W) nozzles of the monochrome printhead, the (X−W) nozzles being located in a second region of the monochrome printhead; and changing a number of nozzles used for printing for each of the color printhead and the monochrome printhead on subsequent passes to complete printing of the horizontal band of scan lines at the edge, wherein a number of monochrome passes required to complete printing of the horizontal band of scan lines at the edge is different than a number of color passes required to complete printing of the horizontal band of scan lines at the edge.

An advantage of the present invention is that an edge-to-edge printing is facilitated without changing the number of passes needed to complete printing of a scan line with a particular printhead, regardless of the location of the scan line on the print medium.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
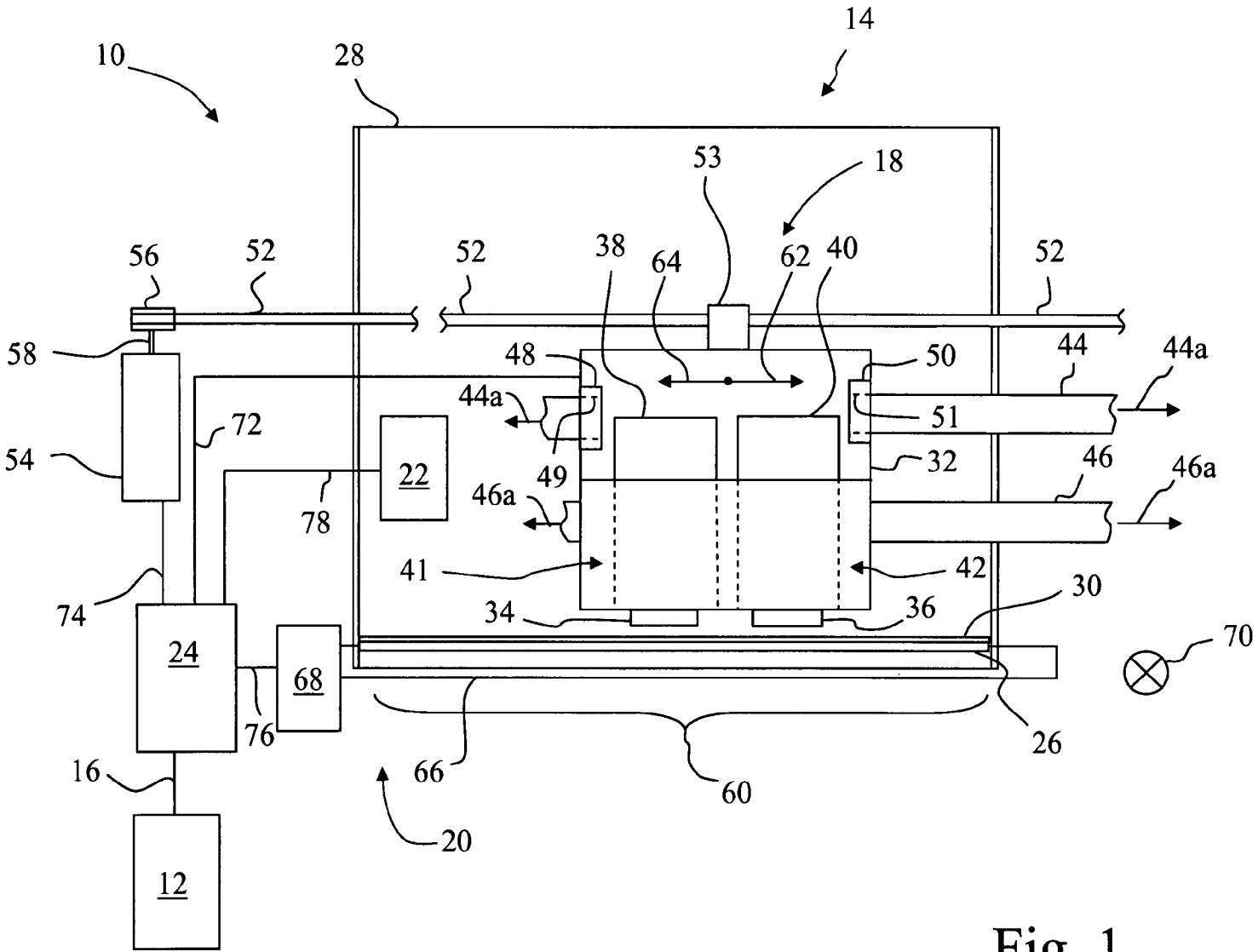
FIG. 1 is a diagrammatic representation of an imaging system embodying the present invention.

Referring now to the drawings, and particularly to FIG. 1, there is shown an imaging system 10 embodying the present invention. Imaging system 10 may include a host 12, or alternatively, imaging system may be a standalone system.

Imaging system 10 includes an imaging apparatus 14, which may be in the form of an ink jet printer 14 as shown. Thus, for example, ink jet printer 14 may be a conventional ink jet printer, or may form the print engine for a multi-function apparatus, such as for example, a standalone unit that has faxing and copying capability, in addition to printing.

Host 12, which may be optional, may be communicatively coupled to ink jet printer 14 via a communications link 16. Communications link 16 may be, for example, a direct electrical connection, a wireless connection, or a network connection.

In embodiments including host 12, host 12 may be, for example, a personal computer including a display device, an input device (e.g., keyboard), a processor, input/output (I/O) interfaces, memory, such as RAM, ROM, NVRAM, and a mass data storage device, such as a hard drive, CD-ROM and/or DVD units. During operation, host 12 includes in its memory a software program including program instructions that function as a printer driver for imaging apparatus 14. The printer driver is in communication with imaging apparatus 14 via communications link 16. The printer driver, for example, includes a halftoning unit and a data formatter that places print data and print commands in a format that can be recognized by imaging apparatus 14. In a network environment, communications between host 12 and imaging apparatus 14 may be facilitated via a standard communication protocol, such as the Network Printer Alliance Protocol (NPAP).

Ink jet printer 14 includes a printhead carrier system 18, a feed roller unit 20, a sheet picking unit 22, a controller 24, a mid-frame 26 and a media source 28.

Media source 28 is configured to receive a plurality of print media sheets from which a print medium 30, e.g., a print media sheet, is picked by sheet picking unit 22 and transported to feed roller unit 20, which in turn further transports print medium 30 during a printing operation. Print medium 30 may be, for example, plain paper, coated paper, photo paper and transparency media.

Printhead carrier system 18 includes a printhead carrier 32 for mounting and carrying a standard color printhead 34 and a monochrome printhead 36, or alternatively a photo printhead. Color printhead 34 may include a plurality of nozzle arrays, each nozzle array being associated with a particular color, such as for example, full strength cyan, full strength magenta and yellow. Likewise, the photo printhead may include a plurality of nozzle arrays, each nozzle array being associated with a particular color, such as for example, dilute cyan, dilute magenta and black. Monochrome printhead 36 may include one or more nozzle arrays associated with black ink.

A standard color ink reservoir 38 is provided in fluid communication with standard color printhead 34, and a monochrome ink reservoir 40, or alternatively a multi-color photo ink reservoir, is provided in fluid communication with monochrome printhead 36. Those skilled in the art will recognize that color printhead 34 and color ink reservoir 38 may be formed as individual discrete units, or may be combined as an integral unitary printhead cartridge 41. Likewise, monochrome printhead 36 and monochrome ink reservoir 40 may be formed as individual discrete units, or may be combined as an integral unitary printhead cartridge 42.

As shown in FIG. 1, printhead carrier 32 is guided by a guide rod 44 and a guide member 46. Each of guide rod 44 and guide member 46 includes a respective horizontal axis 44*a*, 46*a*. Printhead carrier 32 includes a pair of carrier bearings 48, 50, with each of carrier bearings 48, 50 including a respective aperture 49, 51 for receiving guide rod 44. Printhead carrier 32 may further include a glide surface (not shown) that is retained in contact with guide member 46, for example, by gravitational force, or alternatively, by another guide rod bearing or bearing set. The horizontal axis 44*a* of guide rod 44, also sometimes may be referred to herein as X-axis 44*a*, generally defines a bi-directional scanning path for printhead carrier 32. Accordingly, the bi-directional scanning path is associated with each of printheads 34, 36.

Printhead carrier 32 is connected to a carrier transport belt 52 via a carrier drive attachment device 53. Carrier transport belt 52 is driven by a carrier motor 54 via a carrier pulley 56. Carrier motor 54 has a rotating carrier motor shaft 58 that is attached to carrier pulley 56. At the directive of controller 24, printhead carrier 32 is transported in a reciprocating manner along guide rod 44 and guide member 46. Carrier motor 54 can be, for example, a direct current (DC) motor or a stepper motor.

The reciprocation of printhead carrier 32 transports ink jet printheads 34, 36 across the print medium 30, such as paper, along X-axis 44*a* to define a print zone 60 of ink jet printer 14. The reciprocation of printhead carrier 32 occurs in a main scan direction (bi-directional) that is parallel with X-axis 44*a*, and is also commonly referred to as the horizontal direction, including a left-to-right carrier scan direction 62 and a right-to-left carrier scan direction 64. Generally, during each scan of printhead carrier 32 while printing, the print medium 30 is held stationary by feed roller unit 20.

Mid-frame 26 provides support for the print medium 30 when the print medium 30 is in print zone 60, and in part, defines a portion of a print media path of ink jet printer 14.

Feed roller unit 20 includes a feed roller 66 and corresponding index pinch rollers (not shown). Feed roller 66 is driven by a drive unit 68. The index pinch rollers apply a biasing force to hold the print medium 30 in contact with respective driven feed roller 66. Drive unit 68 includes a drive source, such as a stepper motor, and an associated drive mechanism, such as a gear train or belt/pulley arrangement. Feed roller unit 20 feeds the print medium 30 in a sheet feed direction 70, designated as an X in a circle to indicate that the sheet feed direction is out of the plane of FIG. 1 toward the reader. The sheet feed direction 70 is commonly referred to as the sub-scan direction, which is perpendicular to the horizontal bi-directional scanning path, and in turn, perpendicular to the horizontal carrier scan directions 62, 64. Thus, with respect to print medium 30, carrier reciprocation occurs in a horizontal direction and media advance occurs in a vertical direction, and the carrier reciprocation is generally perpendicular to the media advance.

Controller 24 includes a microprocessor having an associated random access memory (RAM) and read only memory (ROM). Controller 24 executes program instructions to effect the printing of an image on the print medium 30, such as for example, by selecting the index feed distance of print medium 30 along the print media path as conveyed by feed roller 66, controlling the reciprocation of printhead carrier 32, and controlling the operations of printheads 34, 36.

Controller 24 is electrically connected and communicatively coupled to printheads 34, 36 via a communications link 72, such as for example a printhead interface cable. Controller 24 is electrically connected and communicatively coupled to carrier motor 54 via a communications link 74, such as for example an interface device and/or cable. Controller 24 is electrically connected and communicatively coupled to drive unit 68 via a communications link 76, such as for example an interface device and/or cable. Controller 24 is electrically connected and communicatively coupled to sheet picking unit 22 via a communications link 78, such as for example an interface device and/or cable.

Figure 2:
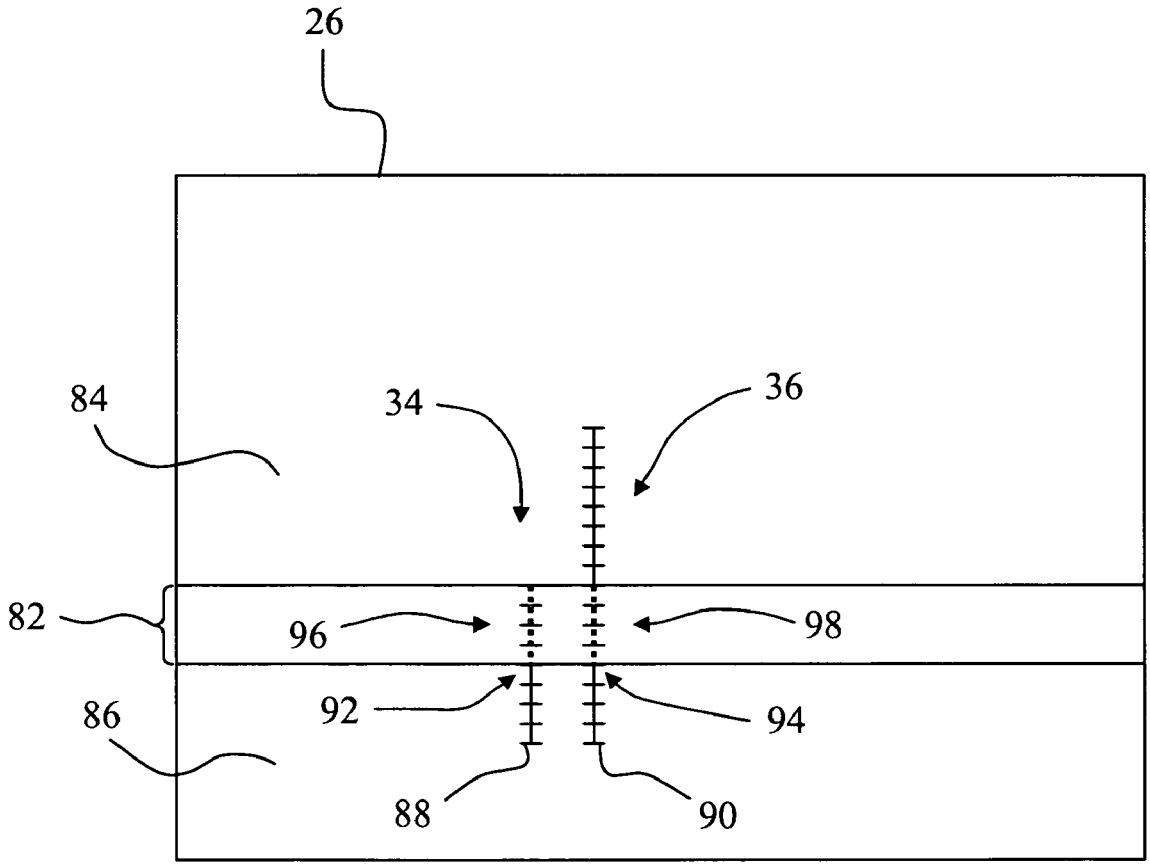
FIG. 2 is a diagrammatic top view showing the relationship of two printheads of different size with respect to a mid-frame of an imaging apparatus included in the imaging system of FIG. 1.
Figure 2:
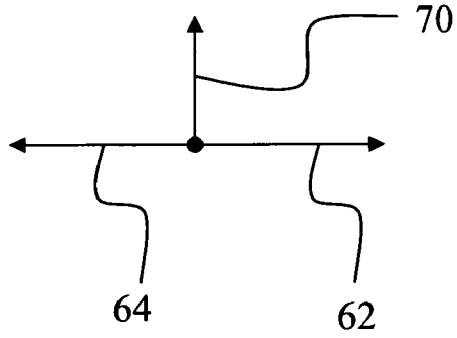

FIG. 2 is a diagrammatic top view showing the relationship of printheads, such as color printhead 34 and monochrome printhead 36, with respect to mid-frame 26. As shown, mid-frame 26 includes a trough 82 that extends in directions 62, 64, and is located such that at least some of the nozzles of each of printheads 34, 36 are positioned over trough 82 so as to facilitate edge-to-edge printing without soiling surfaces 84 and 86 of mid-frame 26 with expelled ink. In the diagram of FIG. 2, each of printheads 34, 36 include a plurality of corresponding nozzles 88, 90 represented by a plurality of short horizontal bars. Each horizontal bar represents a sub-plurality of nozzles, e.g., 20 nozzles per bar. The dots 92, 94, shown along each of printheads 34, 36, respectively, represent the region of the respective printhead that is over trough 82. For example, dots 92 may represent an end region 96 of color printhead 34 that is over trough 82, and dots 94 may represent a central region 98 of monochrome printhead 36 that is over trough 82.

The height of color printhead 34 between its upper-most and lower-most nozzles will be referred to as a full swath height of color printhead 34. Likewise, the height of monochrome printhead 36 between its upper-most and lower-most nozzles will be referred to as a full swath height of monochrome printhead 36.

During printing, an image is formed on print medium 30 by placing ink dots along a plurality of scan lines associated with printheads 34, 36, with color printhead 34 placing color dots along the plurality of scan lines, and with monochrome printhead 36 placing monochrome dots along the plurality of scan lines. In order to complete the printing of a particular scan line, each of printheads 34, 36 will trace over the particular scan line a plurality of times, which will be described in more detail below with respect to the examples that follow.

Figure 3:
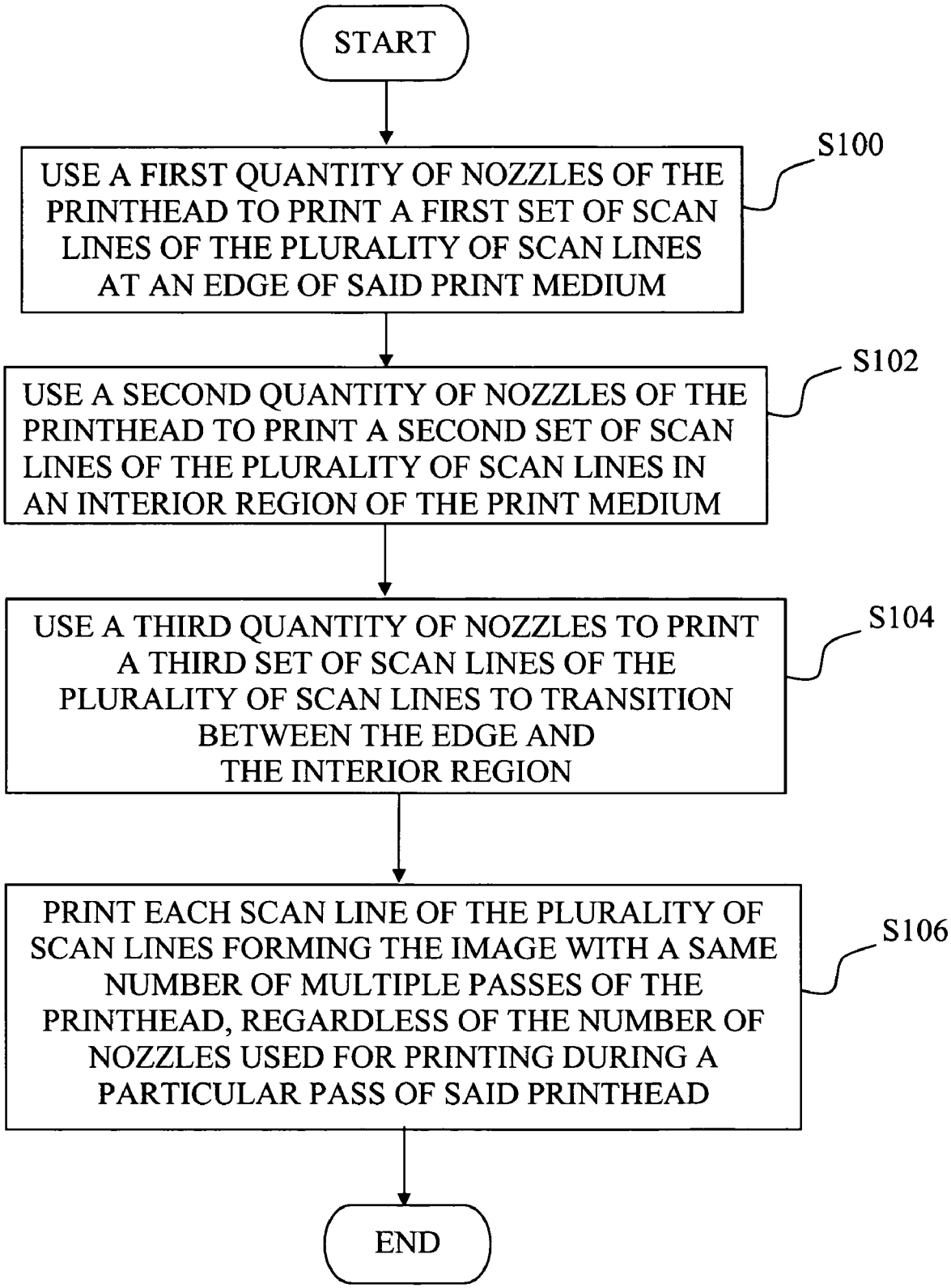
FIG. 3 is a flowchart of a method of printing on a print medium with a plurality of scan lines formed using a printhead, in accordance with the present invention.

FIG. 3 is a flowchart of a method of printing on a print medium, such as print medium 30, with a plurality of scan lines formed using a printhead, such as color printhead 34 or monochrome printhead 36, in accordance with the present invention. In the example, described with respect to FIG. 3, controller 24 may be configured to execute program instructions to perform the steps of the method. Also, while this example is directed to color printhead 34, those skilled in the art will recognize that the principles of the present method apply to monochrome printhead 36, or the optional photo printhead.

Figure 4:
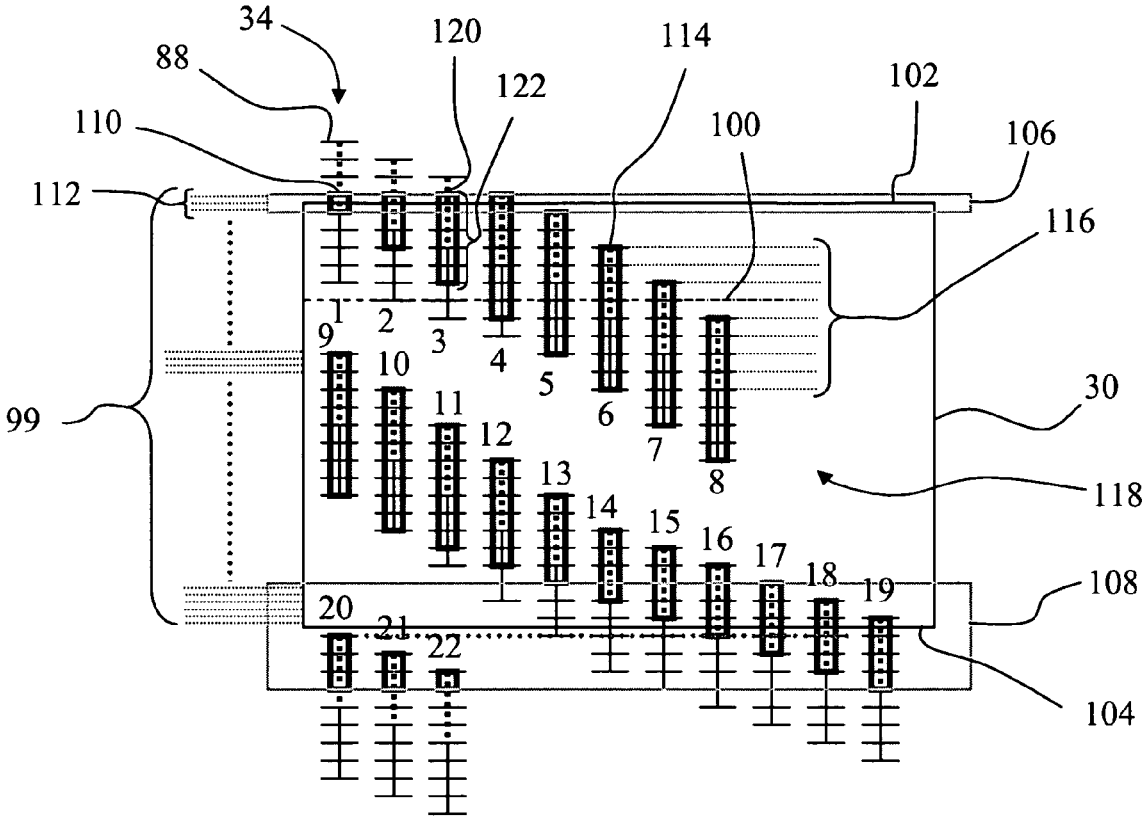
FIG. 4 is a diagrammatic depiction illustrating a plurality of passes of a color printhead with respect to a print medium, in accordance with the present invention.
Figure 4:
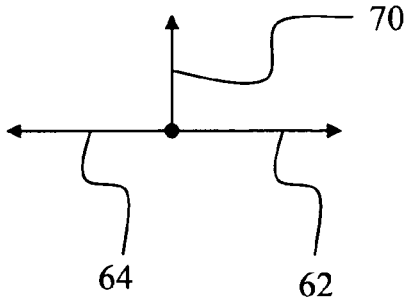

The method of FIG. 3 will be described with respect to the diagrammatic depiction of FIG. 4 illustrating a plurality of passes (passes 1 through 22 are labeled) of color printhead 34 with respect to print medium 30. It is to be understood that the position of color printhead 34 is shown in a relative position with respect to print medium 30 following an advance of print medium 30 in sheet feed direction 70. Printhead carrier 32 reciprocates color printhead 34 in directions 62, 64. As in FIG. 2, each horizontal bar represents a sub-plurality of nozzles, e.g., 20 nozzles per bar. Dots 92 represent an end region 96 of color printhead 34 that is over trough 82. In addition, the various sized rectangles over color printhead 34 represent the portion of color printhead 34 that is used for that particular pass. For example, on pass 1, only a small portion, e.g., about one-eighth, of the nozzles of color printhead 34 is used, whereas in pass 5, the full swath height, e.g., all the nozzles, of color printhead 34 are used.

As can be observed from FIG. 4, a plurality of scan lines 99 that will be formed by color printhead 34, see, for example, scan line 100, will be completed in four passes of color printhead 34, notwithstanding that all nozzles are not used on each pass. Print medium 30 includes a leading edge 102 and a trailing edge 104. Associated with leading edge 102 is a tolerance band 106 represented by a rectangular box, and associated with trailing edge 104 is a tolerance band 108, also represented by a rectangular box. The plurality of scan lines 99 are used in forming an image on print medium 30.

At step S100, a first quantity of nozzles, e.g., nozzles 110, of color printhead 34 is used to print a first set of scan lines 112 of the plurality of scan lines 99 at an edge, e.g., leading edge 102, of print medium 30. The first set of scan lines 112 correspond to the height of the first quantity of nozzles 110, since on pass 1, only the first set of scan lines are started. A portion of the first set of scan lines 112 will not be received by print medium 30, but rather, will be received in trough 82 of mid-frame 26 (see FIG. 2).

At step S102, a second quantity of nozzles, e.g., nozzles 114, of color printhead 34 is used to print a second set of scan lines 116 of the plurality of scan lines 99 in an interior region 118 of the print medium 30. In this example, the second quantity of nozzles may be, for example, a full swath height of color printhead 34.

At step S104, a third quantity of nozzles, e.g., nozzles 120, of color printhead 34 is used to print a third set of scan lines 122 of the plurality of scan lines 99 to transition between the edge, e.g., leading edge 102, and interior region 118. In one embodiment, the third quantity of nozzles may be greater in number than the first quantity of nozzles and less in number than the second quantity of nozzles. During the transition between the edge, e.g., leading edge 102, and interior region 118, the third quantity of nozzles may vary as between at least two consecutive passes of color printhead 34. For example, it is apparent from FIG. 4, for passes 2 through 4, the number of nozzles increases. As a more specific example, the number of nozzles used in pass 4 is more that the number of nozzles used in pass 3, and less than the number of nozzles used in pass 5. Beginning with pass 11, the number of nozzles used is reduced by one-half the size of the paper move of print medium 30 in sheet feed direction 70. Thus, at pass 14, color printhead 34 is over the tolerance band 108 for where the trailing edge 104 actually is positioned, so that only nozzles positioned over trough 82 are used.

In one example, the third quantity of nozzles may increase as between the at least two consecutive passes of color printhead 34 when the edge is leading edge 102 of print medium 30 (see, for example, pass 4 and pass 5). In another example, the third quantity of nozzles may decrease as between the at least two consecutive passes of color printhead 34 when the edge is trailing edge 104 of print medium 30 (see, for example, pass 13 and pass 14).

At step S106, as shown in FIG. 4, it is noted that each scan line of the plurality of scan lines 99 is printed in forming the image with a same number of multiple passes of color printhead 34, e.g., four passes, regardless of the number of nozzles used for printing during a particular pass of the color printhead 34.

As mentioned above, the principles of the present method may be applied to a color printhead and/or a monochrome printhead. In such an embodiment, monochrome printhead 36 is provided for printing monochrome dots along the plurality of scan lines. A number of passes of color printhead 34 required for printing all of the color dots for a scan line of said plurality of scan lines may be different than a number of passes of monochrome printhead 36 required for printing all of the monochrome dots for the same scan line of the plurality of scan lines. For example, the number of passes of monochrome printhead 36 may be greater than the number of passes of color printhead 34, and in one particular embodiment, the number of passes of monochrome printhead 36 is double that of the number of passes of color printhead 34.

Figure 5:
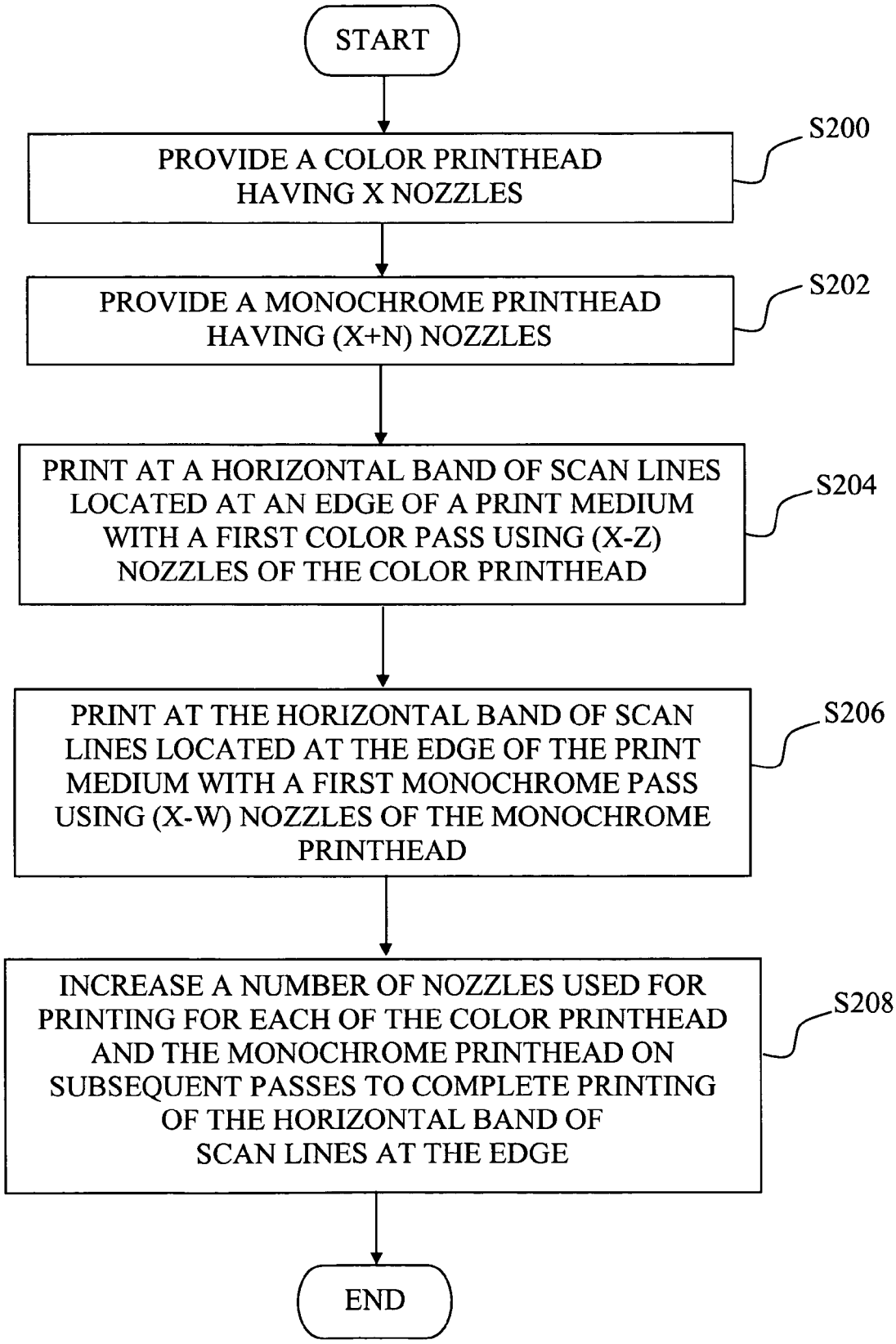
FIG. 5 is a flowchart of an edge-to-edge printing method, in accordance with the present invention, that utilizes two printheads.

FIG. 5 is a flowchart of an edge-to-edge printing method, in accordance with the present invention, that utilizes two printheads, e.g., color printhead 34 and monochrome printhead 36. In the example, described with respect to FIG. 5, controller 24 may be configured to execute program instructions to perform the steps of the method.

Figure 6:
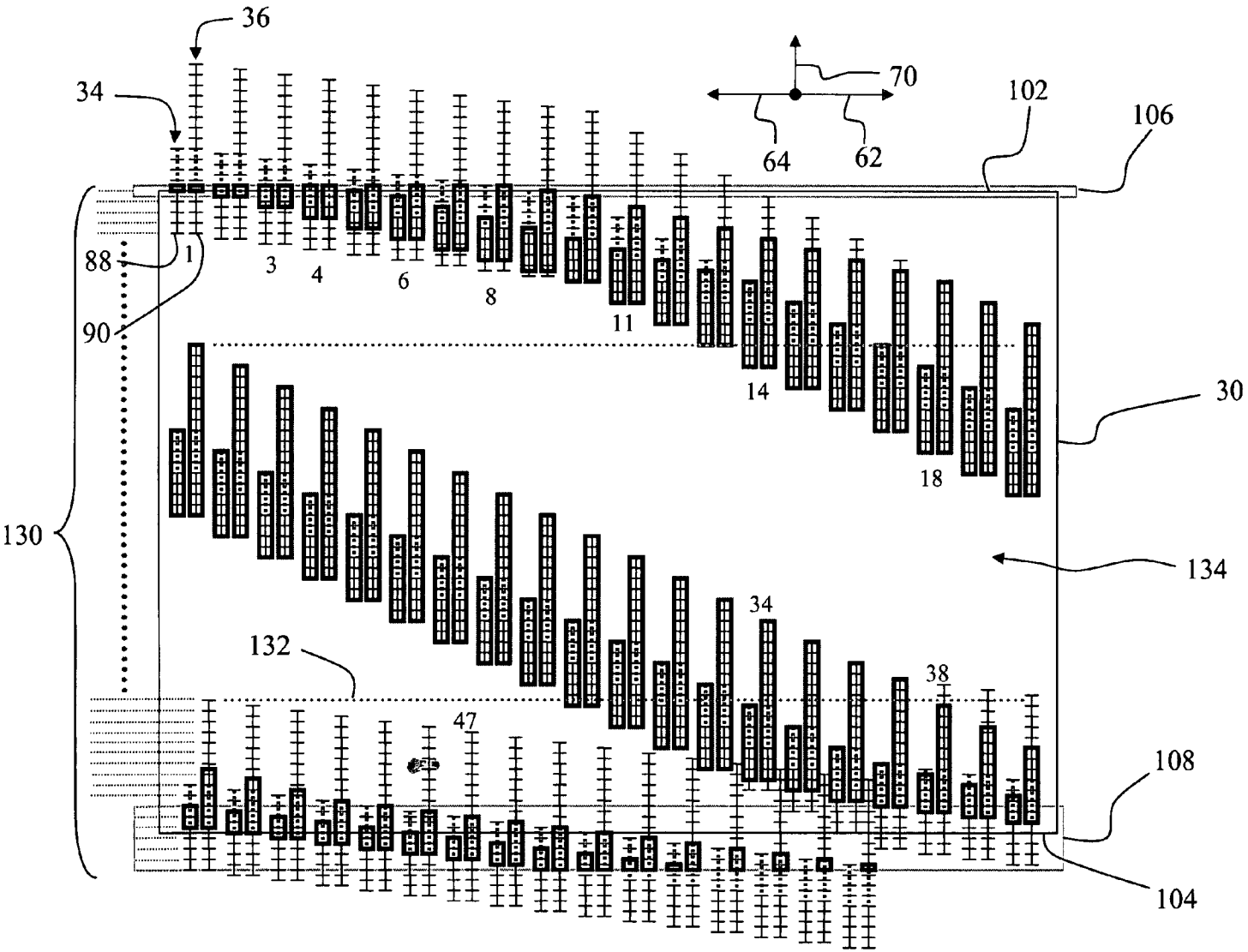
FIG. 6 is diagrammatic depiction illustrating a plurality of passes of a color printhead and a monochrome printhead with respect to a print medium, in accordance with the present invention.

The method of FIG. 5 will be described with respect to the diagrammatic depiction of FIG. 6 illustrating a plurality of passes (passes 1, 3, 4, 6, 8, 11, 14, 18, 34, 38 and 47 are labeled) of color printhead 34 and monochrome printhead 36 with respect to print medium 30. It is to be understood that the positions of color printhead 34 and monochrome printhead 36 are shown in relative positions with respect to print medium 30 following an advance of print medium 30 in sheet feed direction 70. Printhead carrier 32 reciprocates color printhead 34 and monochrome printhead 36 in directions 62, 64. Referring also to FIG. 2, each of printheads 34, 36 include a plurality of corresponding nozzles 88, 90 represented by a plurality of short horizontal bars. Each horizontal bar represents a sub-plurality of nozzles, e.g., 20 nozzles per bar. The dots 92, 94, shown along each of printheads 34, 36, respectively, represent the region of the respective printhead that is over trough 82. Dots 92 may represent an end region 96 of color printhead 34 that is over trough 82, and dots 94 may represent a central region 98 of monochrome printhead 36 that is over trough 82.

In addition, the various sized rectangles over color printhead 34 and monochrome printhead 36 represent the portion of color printhead 34 and monochrome printhead 36, respectively, which is used for that particular pass. For example, on pass 1, only a small portion, e.g., nine, of the nozzles of color printhead 34 is used, whereas in pass 14, the full swath height, e.g., all the nozzles, of color printhead 34 are used. Likewise, For example, on pass 1, only a small portion, e.g., nine, of the nozzles of printhead 36 is used, whereas in pass 18, the full swath height, e.g., all the nozzles, of printhead 34 are used.

As can be observed from FIG. 6, the plurality of scan lines 130 that will be formed by color printhead 34 (see, for example, scan line 132) will be completed in four passes of color printhead 34, notwithstanding that all nozzles are not used on each pass. Likewise, the plurality of scan lines 130 that will be formed by monochrome printhead 36 (see, for example, scan line 132) will be completed in eight passes of monochrome printhead 36, notwithstanding that all nozzles are not used on each pass.

Print medium 30 includes leading edge 102 and trailing edge 104. Associated with leading edge 102 is tolerance band 106 represented by a rectangular box, and associated with trailing edge 104 is tolerance band 108 represented by a rectangular box. The plurality of scan lines 130 are used in forming an image on print medium 30.

At step S200, color printhead 34 is provided having X nozzles. In this example, X is equal to 160, and represents the full swath height of color printhead 34.

At step S202, monochrome printhead 36 is provided having (X+N) nozzles. In this example, (X+N) equals 320 nozzles, and represents the full swath height of monochrome printhead 36.

At step S204, a horizontal band of scan lines, e.g., a band nine nozzles high, is printed located at an edge, e.g., leading edge 102, of a print medium 30, with a first color pass, e.g., pass 1, using (X−Z) nozzles of said color printhead. In this example, (X−Z) is equal to 9 nozzles. The (X−Z) nozzles are located in a first region, e.g., end region 96 of color printhead 34 (see also FIG. 2).

At step S206, the process prints at the same horizontal band of scan lines located at the edge, e.g., leading edge 102, of print medium 30 with a first monochrome pass, e.g., pass 1, using (X−W) nozzles of monochrome printhead 36. In this example, W is equal to Z for pass 1. The (X−W) nozzles of monochrome printhead 36 are located in a second region, e.g., central region 98, of monochrome printhead 36 (see also FIG. 2).

At step 208, the process changes a number of nozzles used for printing for each of color printhead 34 and monochrome printhead 36 on subsequent passes to complete printing of horizontal band of scan lines at the edge, e.g., leading edge 102, wherein a number of monochrome passes required to complete printing of the horizontal band of scan lines at the edge is different, e.g., greater, than a number of color passes required to complete printing of the horizontal band of scan lines at the edge, e.g., leading edge 102.

The type of change in the number of nozzles used for printing for each of color printhead 34 and monochrome printhead 36 at the edge will depend on which edge is being printed. For example, for leading edge 102, the change is an increase in the number of nozzles for each of color printhead 34 and monochrome printhead 36, and for trailing edge 104, the change is a decrease in the number of nozzles for each of color printhead 34 and monochrome printhead 36.

As can be observed from FIG. 6, a full swath height of each of color printhead 34 (passes 14 through 33 in this example) and monochrome printhead 36 (passes 18 through 33 in this example) is used for printing at least an intermediate region 134 of print medium 30, without changing a number of passes required to print a particular horizontal band of scan lines in intermediate region 134 from the number of passes required to print the horizontal band of scan lines at the edge, e.g., leading edge 102. In other words, in this example, throughout the printing of print medium 30, color printhead 34 uses 4 passes to complete printing of each scan line, and monochrome printhead 36 uses 8 passes to complete printing of each scan line, regardless of the location of the scan line on print medium 30.

In the example of FIG. 6, only two sizes of paper moves are needed, referred to as a regular move, and a reduced size move, e.g., a one-quarter regular size move. A reduced size paper move in sheet feed direction 70 is used for passes 1 through 9. For passes 10 through 37, a regular size paper move is used. For passes 38 through the last pass, the reduced size paper move is again used.

While this invention has been described with respect to embodiments of the present invention, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of printing on a print medium with a plurality of scan lines formed using a printhead, comprising:

using a first quantity of nozzles of said printhead to print a first set of scan lines of said plurality of scan lines at an edge of said print medium;

using a second quantity of nozzles of said printhead to print a second set of scan lines of said plurality of scan lines in an interior region of said print medium;

using a third quantity of nozzles to print a third set of scan lines of said plurality of scan lines to transition between said edge and said interior region, said third quantity of nozzles being greater in number than said first quantity of nozzles and less in number than said second quantity of nozzles; and printing each scan line of said plurality of scan lines forming said image with a same number of multiple passes of said printhead, regardless of said number of nozzles used for printing during a particular pass of said printhead.

2. The method of claim 1, wherein during said transition between said edge and said interior region, said third quantity of nozzles varies as between at least two consecutive passes of said printhead.

3. The method of claim 2, wherein said third quantity of nozzles increases as between said at least two consecutive passes of said printhead when said edge is a leading edge of said print medium.

4. The method of claim 2, wherein said third quantity of nozzles decreases as between said at least two consecutive passes of said printhead when said edge is a trailing edge of said print medium.

5. The method of claim 1, wherein said printhead is one of a color printhead and a monochrome printhead.

6. The method of claim 1, said printhead being a color printhead for printing color dots along said plurality of scan lines, said method further comprising:

providing a monochrome printhead for printing monochrome dots along said plurality of scan lines;

wherein a number of passes of said color printhead required for printing all of said color dots for a scan line of said plurality of scan lines is different than a number of passes of said monochrome printhead required for printing all of said monochrome dots for said scan line of said plurality of scan lines.

7. The method of claim 6, wherein said number of passes of said monochrome printhead is greater than said number of passes of said color printhead.

8. The method of claim 6, wherein said number of passes of said monochrome printhead is double said number of passes of said color printhead.

9. An edge-to-edge printing method, comprising:

providing a color printhead having X nozzles;

providing a monochrome printhead having X+N nozzles;

printing at a horizontal band of scan lines located at an edge of a print medium with a first color pass using (X−Z) nozzles of said color printhead, said (X−Z) nozzles being located in a first region of said color printhead;

printing at said horizontal band of scan lines located at said edge of said print medium with a first monochrome pass using (X−W) nozzles of said monochrome printhead, said (X−W) nozzles being located in a second region of said monochrome printhead; and changing a number of nozzles used for printing for each of said color printhead and said monochrome printhead on subsequent passes to complete printing of said horizontal band of scan lines at said edge, wherein a number of monochrome passes required to complete printing of said horizontal band of scan lines at said edge is different than a number of color passes required to complete printing of said horizontal band of scan lines at said edge.

10. The method of claim 9, further comprising using a full swath height of each of the color printhead and the monochrome printhead for printing at least an intermediate region of said print medium, without changing a number of passes required to print a particular horizontal band of scan lines in said intermediate region from a number of passes required to print said horizontal band of scan lines at said edge.

11. The method of claim 10, wherein said edge is one of a leading edge and a trailing edge of said print medium.

12. The method of claim 9, wherein said first region of said color printhead is an end region of said color printhead.

13. The method of claim 9, wherein said second region of said monochrome printhead is a central region of said color printhead.

14. The method of claim 9, wherein W is equal to Z.

15. The method of claim 9, wherein said number of monochrome passes required to complete printing of said horizontal band of scan lines at said edge is greater than said number of color passes required to complete printing of said horizontal band of scan lines at said edge.

* * * * *